United States Patent [19]

Gregory et al.

[11] Patent Number: 4,952,278

[45] Date of Patent: Aug. 28, 1990

[54] HIGH OPACITY PAPER CONTAINING EXPANDED FIBER AND MINERAL PIGMENT

[75] Inventors: Paul E. Gregory; Kenneth D. Vinson, both of Germantown, Tenn.

[73] Assignee: The Procter & Gamble Cellulose Company, Memphis, Tenn.

[21] Appl. No.: 360,649

[22] Filed: Jun. 2, 1989

[51] Int. Cl.[5] ..... D21H 17/67; D21H 11/18

[52] U.S. Cl. ..... 162/141; 162/181.1; 162/181.2; 162/181.3; 162/181.5; 162/181.6; 162/181.8; 162/187

[58] Field of Search ..... 162/9, 141, 187, 100, 162/181.1, 181.3, 181.5, 181.2, 181.8, 181.6, 181.4

[56] References Cited

U.S. PATENT DOCUMENTS

| | | | |
|---|---|---|---|
| 4,481,076 | 11/1984 | Herrick | 162/158 |
| 4,483,743 | 11/1984 | Turbak et al. | 162/100 |
| 4,627,743 | 11/1986 | Gess | 162/164.1 |
| 4,761,203 | 8/1988 | Vinson | 162/9 |

OTHER PUBLICATIONS

Casey, *Pulp and Paper,* 3rd Ed., vol. III, pp. 1515–1546.

Alince, "The Effect of Fiber Beating on $TiO_2$ Pigment Performance", *Tappi,* Oct. 1987, pp. 114–117.

Jaycock et al., "A Study of the Retention of Pigment During Paper Formation", Journal of Colloid and Interface Sci., vol. 55, No. 1, (Apr. 1976), pp. 181–190.

*Primary Examiner*—Peter Chin

*Attorney, Agent, or Firm*—Bart S. Hersko; Thomas J. Slone; Fredrick H. Braun

[57] ABSTRACT

A paper structure having both high opacity and improved tensile strength through the incorporation of expanded fiber and an opacifying mineral pigment, such as titanium dioxide, is disclosed. The addition of expanded fiber to the paper structure makes it possible to increase the opacity of the paper through the use of the conventional mineral pigments without adversely affecting the paper's tensile strength. These opacified paper structures are especially useful for producing high quality, strong, light weight printing and writing papers which require material pigments for enhanced opacity.

11 Claims, No Drawings

HIGH OPACITY PAPER CONTAINING EXPANDED FIBER AND MINERAL PIGMENT

TECHNICAL FIELD

This invention relates, in general, to high opacity paper; and more specifically, to high opacity, light weight printing and writing papers.

BACKGROUND OF THE INVENTION

Paper that is thinner and lighter in weight is being increasingly demanded to reduce the weight of printed material that must be shipped and mailed. This trend in the paper industry toward lighter weight printing papers has made it necessary to find a means for maintaining in light weight sheets the optical properties such as opacity normally found in heavier weight papers. To impart opacity to such papers, the paper is filled or loaded with mineral pigments. Unfortunately, the use of conventional mineral pigment fillers such as clay and titanium dioxide in the amounts necessary to obtain the desired optical properties can result in severe deterioration of the strength characteristics of the paper. Various techniques have been proposed for producing light weight paper sheets possessing both sufficient strength and the desired optical properties, however, none of these techniques have truly been successful.

For example, a well known method of increasing tensile strength of paper made from cellulosic pulp is by mechanically refining the pulp prior to papermaking. However, while additional refining increases tensile strength, it invariably reduces the opacity of the resulting paper. Another method of compensating for the loss in strength associated with mineral pigment inclusion is through the use of substantial levels of resins, latex, or other dry strength additives. Such dry strength additives can add substantial raw materials cost to the paper due to the relatively high level of additive required to provide sufficient strength.

It has now been discovered that adding expanded fiber to paper containing mineral pigments increases the effectiveness of such pigments and improves tensile strength simultaneously. That is, paper products containing the combination of expanded fiber and an opacifying mineral pigment exhibit both higher opacity and tensile strength than paper containing only a mineral pigment. Moreover, neither the use of the specific combination of expanded fiber and a mineral pigment, nor the desirable opacity and tensile strength properties of paper structures containing these components appear to have been appreciated heretofore.

Expanded fiber is a substance made from fibrous material having a fibrillar ultrastructure, wherein the fibrous material has been processed in such a way as to cause fibrils to separate from, or become disassociated from, the fibrous material ultrastructure. Alternatively, expanded fiber can be considered as cellulosic fibrous material which has been expanded from a fibrous form to a fibrillar form. Expanded fiber from natural, cellulosic fibers is of particular interest herein.

Cellulosic fibers are multi-component ultrastructures made from cellulose polymers. Lining, pentosans and other components known in the art may also be present.

The cellulose polymers are aggregated laterally to form threadlike structures called microfibrils. Microfibrils are reported to have diameters of about 10–20 nm, and are observable with an electron microscope. Microfibrils frequently exist in the form of small bundles known as macrofibrils. Macrofibrils can be characterized as a plurality of microfibrils which are laterally aggregated to form a threadlike structure which is larger is diameter than a microfibril, but substantially smaller than a cellulosic fiber. In general, a cellulosic fiber is made up of a relatively thin primary wall and a relatively thick secondary wall. The primary wall, a thin, net-like covering located at the outer surface of the fiber, is principally formed from microfibrils. The bulk of the fiber wall, i.e., the secondary wall, is formed from a combination of microfibrils and macrofibrils. See Pulp and Paper Manufacture, Vol. 1, Properties of Fibrous Raw Materials and Their Preparation For Pulping, ed. by Dr. Michael Kocurek, Chapter VI, "Ultrastructure and Chemistry", pp 35–44, published jointly by Canadian Pulp and Paper Industry (Montreal) and Technical Association of the Pulp and Paper Industry (Atlanta), 3rd ed., 983, incorporated herein by reference. The cellulosic fiber walls constitute the ultrastructure of the cellulosic fiber. Microfibrils and macrofibrils shall hereinafter be collectively referred to as "fibrils." Expanded fiber from cellulosic fibers thus refers to fibrils which have been substantially separated from or disassociated from a cellulosic fiber ultrastructure. Fibrous material in this condition shall hereinafter be referred to as being in "fibrillar" form.

Production of expanded fiber, of any type, from fibrous material having a fibrillar ultrastructure involves expansion of the fibrous material from a primarily fibrous form to, at least, a partially fibrillar form. One method for producing expanded fiber from cellulosic, fibrous material is disclosed in U.S. Pat. No. 4,483,743, Turbak, et al., issued Nov. 20, 1984. Expanded fiber, referred to therein as microfibrillated cellulose, is produced by passing a liquid suspension of cellulose fibers through a small diameter orifice, in which the suspension is subjected to a pressure drop of at least 3000 psig and a high velocity shearing action, followed by a high velocity decelerating impact. Passage of the suspension through the orifice is repeated until a substantially stable suspension is obtained.

A preferred method for producing expanded fiber from cellulosic, fibrous material is disclosed in U.S. Pat. No. 4,761,203, Vinson, issued Aug. 2, 1988, incorporated herein by reference. The expanded fiber referred to therein is produced by a process wherein fibrous material having fibrillar ultrastructure is mechanically fibrillated by impacting fine media against such fibrous material. This process involves the steps of first impacting the fibrous material with a plurality of fine media such that fibrils of the fibrous material are separated from fibrous material ultrastructure; and then separating the fibrous material from the fine media. Such treatment may be implemented with apparatuses known as fine media mills, agitated fine media mills and sand mills. Preferably, a horizontal fine media mill, wherein flow of fibrous material through the fine media mill occurs in a substantially horizontal direction, is utilized. Vertical fine media mills and media mills at angles between horizontal and vertical configurations are also applicable.

Other methods in the paper industry have been proposed to increase the level of fibrillation conventionally observed for pulped, cellulosic fiber. For example, beating and additional refining of pulp in excess of the level conventionally practiced in order to provide a commercially saleable product are well known to increase fibrillation. However, beating and refining as practiced in the cellulose fiber industry are relatively inefficient processes. Large amounts of energy are expended to gain relatively low amounts of fiber expansion and fibrillation. In these processes, the fiber is abraded to form a fiber having a "fuzzy" character, while the fiber walls, and hence the ultrastructure, are retained substantially intact. Beating and refining, generally implemented by abrasion and impacting of suspended fibers by entrapment between a rotor or stator, have been found to be of extremely limited utility for producing expanded fiber due to the prolonged period of fiber treatment necessary to achieve levels of fibrillation significant for the manufacture of expanded fiber. Another disadvantage of fibrillation by conventional beating and refining apparatuses is that a high level of wear would be incurred upon the apparatus surfaces.

The process of adding mineral pigment fillers to papermaking furnishes prior to the formation of the paper sheet is well known in the art. See for example, Smook, *Handbook for Pulp & Technologists*, pages 204–207 (1987). In particular, finely divided white mineral pigments are frequently added to papermaking furnishes to improve the optical and physical properties of the sheet. Such white mineral pigments are highly desirable in printing papers where they increase the opacity, raise the brightness, and generally improve the printing properties. The application of these mineral pigments is especially important when opacity is needed at a low basis weight.

The most commonly used papermaking opacifying mineral pigments are clay, calcium carbonate, talc, and titanium dioxide. Clay is the most widely used filler pigment because it is a cheap, plentiful, stable and provides generally good performance. Calcium carbonate is used only in alkaline or neutral systems because of its solubility at lower pH levels. It is available at a higher brightness level than clay and is a better opacifier. Talc is a hydrated magnesium silicate with the approximate formula of $H_2Mg_3(SiO_3)_4$. Talc is notable as a "soft" filler, imparting a soft silky feel to the paper product. Titanium dioxide is the brightest and most effective opacifier. Only a fraction as much titanium pigment is needed to produce the same opacity as clay, and this difference is particularly noticeable in paper of low basis weight. Another feature of titanium dioxide filled paper is reduced show through after printing. The high price of this pigment does not permit indiscriminate use, therefore, titanium dioxide is used primarily to produce high-quality and high-priced paper products.

The use of titanium dioxide as well as other mineral pigments result in some undesirable effects, principally a measurable and often significant decrease in the strength of the paper. That is, the price paid for the improvement of the optical properties of paper through the addition of a opacifying mineral pigment is often a significant loss in tensile strength. Accordingly, it would be highly desirable to be able to increase the opacity of paper through the use of conventional mineral pigments without adversely affecting the paper's tensile strength.

It is therefore an object of this invention to provide a high opacity paper structure, containing expanded fiber and an opacifying mineral pigment, which has improved strength properties.

It is a further object of this invention to provide a low basis weight paper structure which has a higher opacity at a particular level of tensile strength relative to paper of the same basis weight which does not contain expanded fiber.

These and other objects are obtained using the present invention, as will be seen from the following disclosure.

SUMMARY OF THE INVENTION

In one aspect of the invention, an opacified paper structure is provided comprising cellulosic fibers, an effective amount of expanded cellulosic fibers, and an effective amount of an opacifying mineral pigment. The paper structure has a basis weight of from about 20 to about 120 grams per square meter, and a density of about 1.0 grams or less per cubic centimeter. Preferably, the mineral pigment is titanium dioxide in an amount of from about 1% to about 15% based on the dry weight of the paper structure. An especially unexpected benefit of this specific combination of opacifying mineral pigment and expanded cellulosic fibers is the high level of tensile strength at a given level of opacity or conversely, high level of opacity for a given tensile strength.

All percentages, ratios and proportions herein are by weight, unless otherwise specified.

The present invention is described in more detail below.

DETAILED DESCRIPTION OF THE INVENTION

Briefly, the present invention is a light-weight paper structure having both high opacity and improved tensile strength through the incorporation of expanded fiber and an opacifying pigment such as titanium dioxide into the paper structure. That is, the combination of expanded fiber and an opacifying pigment in a paper structure makes it possible to increase both the opacity and tensile strength of the resulting paper product. This invention is particularly useful for producing high quality, strong, light weight printing and writing papers which require mineral pigments for enhanced opacity.

While not wishing to be bound by theory or to otherwise limit the present invention, the following explanation is offered for the unique ability of expanded fiber to increase both tensile strength and opacity of paper structures. Expanded fiber increases tensile strength by increasing the number of hydrogen bonds per unit volume of the paper structure. It is capable of doing this because of its vast surface area made available for hydrogen bonding by the extreme fibrillation present in the expanded fiber material. In addition to this function, the substantially separated fibrils present in expanded fiber are capable of separating particles of mineral pigments which would otherwise be able to form agglomerates wherein the individual particles could be in physical contact. The physical contact of pigment particles can lead to some air-pigment interface, where the scattering of light takes place, to be replaced with optically inactive pigment-pigment interface. Therefore, expanded fiber can increase the opacifying efficiency of mineral pigments by keeping the individual pigment particles separate.

Cellulosic fibers which may be utilized for the present invention include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex TM, available from Hercules, Inc. (Wilmington, Del.).

Applicable wood pulps include chemical pulps made by the Kraft, sulfite, and sulfate processes; and mechanical pulps including, for example, groundwood, thermomechanical pulp and chemically modified thermomechanical pulp. Chemical pulps, however, are preferred because of their superior strength properties. Pulps may be utilized which are derived from both deciduous trees which are sometimes referred to as "hardwood"; and coniferous trees which are sometimes referred to as "softwood". In particular, bleached Kraft blends of hardwood and softwood pulps lightly refined (preferably not below about 500 ml Canadian Standard Freeness before addition of mineral pigments and/or expanded fiber) are preferred for use in the present invention.

As mentioned above, the highly fibrillated cellulosic fibrous material, hereinafter "expanded fiber" used in the present invention is preferably produced according to the process disclosed in U.S. Pat. No. 4,761,203, Vinson, issued Aug. 2, 1988, incorporated herein by reference. In Vinson, the expanded fiber is made by impacting fine media against fibrous material. Impacting of the fine media against the fibrous material is continued at least until a portion of the fibrils of the fibrous material are separated from the fibrous material ultrastructure.

The type of fibrous material which may be used with the process disclosed in Vinson include any fibrous material which has a fibrillar ultrastructure. However, the present invention is limited to expanded fibers produced from cellulosic fibers. Therefore, the remainder of this description of the Vinson process will focus upon the manufacture of expanded fiber from cellulosic fibers.

Cellulosic fibers of diverse natural origins may be used, including softwood fibers, hardwood fibers, cotton linter fibers, and also fibers from Esparto grass, bagasse, hemp and flax. Preferably chemically pulped fibers from wood sources are utilized, since such fibers are believed to be more efficiently fibrillated into expanded fiber. Specifically, chemically pulped fibers are preferred over mechanically pulped fibers such as groundwood, thermomechanical pulp, and chemithermomechanical pulp, since lining present in mechanically pulped fibers binds the fibrils tightly in position and inhibits fiber plasticization. Consequently, fibrillation efficiency is low relative to similar treatment of chemically pulped wood fibers. Cellulosic fibers having substantial levels of hemicellulose are preferred over high alpha cellulose content fibers, such as cotton, characterized by the substantial absence of hemicellulose. High alpha cellulose content fibers can also be prepared from cellulosic fibers from wood and vegetable sources by chemical pulping methods. The reason for this preference of hemicellulose-containing fibers is that such fibers are more susceptible to plasticization and the resulting plasticized fibers are more susceptible to fibrillation, than low hemicellulose fibers. Generally, fibers provided from conventional chemical pulp processes will have, by weight percent, between about 10% and about 15% hemicellulose. Fibers with hemicellulose levels within or above this range are preferred for the manufacture of expanded fibers used in the present invention.

Regardless of source, the fibers should be provided in an unsheeted form prior to initiation of mechanical expansion, to facilitate efficient and effective action by the media and flowability of the fibers through the equipment utilized to impact the fine media against the fibers.

Upon mechanical impact with fine media, primarily interfibrillar bonds between cellulose molecules, such as mechanical bonds and hydrogen bonds are broken. With the affected bonds broken, the fibrils or parts thereof become separated from the fiber ultrastructure. This phenomenon is referred to as "expansion" of the fiber. Upon a sufficient level of impact with fine media, a substantial portion of the fiber is converted to a highly expanded, fibrillar state. Preferably, essentially the entire fiber is converted to such fibrillar state, wherein the fiber ultrastructure is substantially completely expanded to fibrillar form.

In order to facilitate mechanical expansion by the action of fine media, the fibers should be softened, i.e. plasticized, as previously discussed. This can be accomplished by contacting the fibers with a polar liquid, such as (but not limited to) water and ethylene glycol, prior to or during the initial stages of mechanical expansion. The amount of fluid required to plasticize chemically pulped fibers in general will correspond with the amount of fluid required to induce swelling of the fibers. Typically, a slurry having a fiber consistency of, by weight percent, less than about 50% is preferred. However, as discussed below, larger amounts of fluid will generally be desired in order to facilitate transport of the fibrous material.

Significantly, impact of the fine media against the fibers result in mechanical expansion of the fibers into individualized microfibrils. Such microfibrils have high surface areas and high cellulose chain length relative to particulate, powdered, or finely chopped fibrous, cellulosic material. These differences in chain length and surface area are believed to contribute significantly to the high absorptivity, gellability, and strength-providing characteristics of expanded fiber.

In the preferred embodiments, fibrous material is impacted with media with a fine media mill. Fine media mills may be alternatively referred to as agitated media mills, agitated fine media mills, and sand mills. Fine media mills are described generally in "Horizontal Media Milling With Computer Controls," Modern Paint and Coatings, June, 1984, by Christ Zoga, hereby incorporated by reference into this disclosure. Vertical and horizontal agitated media mills, both described therein, are both applicable to the present invention. In general, a fine media mill has a cylindrical tube, a rotatable shaft disposed inside the tube, a plurality of impellers attached to the rotatable shaft, means for rotating the shaft, fine media disposed inside the tube, and means for separating the expanded fiber from the fine media. The purpose of the impellers is to agitate the fine media and thereby facilitate impact of the media against the material to be treated. The cylindrical tube is vertically oriented for vertical agitated media mills. Horizontal agitated media mills are preferred, due to better flow through the mill and higher media loading capability. Higher media loading capacity enables the horizontal agitated media mill to operate at higher efficiency and produce treated product in shorter periods of time. The impellers in horizontal mills serve an additional function of restricting direct flow through the mill. Horizontal agitated media mills are commercially available from Premier Mill Corporation, New York, N.Y.

Sand mills, a category of vertical fine media mills, as exemplified in U.S. Pat. Nos. 3,545,687, 3,995,818, 3,960,331, 3,685,749, 3,984,055, and 4,140,283 are also contemplated for fibrillation of fibrous material, and the above-referenced patents are hereby incorporated by reference into this disclosure.

A variety of types of fine media may be used to expand fibrous material. These include glass beads, ceramic beads, zirconium silicate beads, zirconium oxide beads, and steel or other metal shots. The fine media may be spherical, elliptical, or of another geometric shape. The fine media may have rounded or angular edges. The equivalent diameters of the fine media are preferably between about 0.5 mm and about 3 mm, wherein equivalent diameter is calculated according to the following equation:

$$ED = \left(\frac{6 \cdot V}{\pi}\right)^{\frac{1}{3}} \quad (1)$$

where ED is equivalent diameter; and
V is volume of an individual fine media.

In operation, rotation of the impellers of the media mill propel the fine media, thus causing the fine media to impact against the fibrous material. The velocity at which the fine media must strike the fibers in order to effect expansion into fibrillar form will depend upon the type, size, and weight of the fine media, the degree of plasticization of the fibers. Efficiency of fibrillation will additionally depend upon the percentage of fibers and fine media in the media mill relative to the volume of the area wherein fibrillation occurs. For practical purposes, there will exist a minimum speed at which the fine media must impact against the fibers to achieve substantial levels of fibrillation. This level will depend upon the factors listed above. In general, higher levels of fibrillation will be associated with higher proportions of a particular type and shape of fine media in a given media mill. Factors affecting fibrillation will be exemplified in more detail below. Upon settling, a well mixed slurry of cellulosic fibrous material generally tends to separate into a cellulose-containing phase and a non-cellulose-containing phase. For convenience and practicability, expanded fiber from cellulosic fibrous material within the scope of this invention can be defined in terms of the consistency of an aqueous slurry of the fibrous material for which, upon 60 minutes undisturbed settling of a well mixed, 0.5% consistency aqueous slurry (fibrous material percentage of slurry, weight basis) in the substantial absence of emulsifying or other stabilizing agents, the post-settling cellulose-containing phase of the slurry retains at least 50% of the volume of the slurry.

The consistency at which a cellulose-containing phase of an aqueous solution as described above separates into equal volumetric parts of cellulose-containing slurry and noncellulose-containing water after a 60 minute period of unagitated settling, shall hereinafter be referred to as the 50% volumetric reduction settling consistency. This consistency hereinafter referred to shall be calculated on a weight basis wherein the weight of fibrous material, in expanded or unexpanded form, is determined as a percentage of the total weight of the aqueous slurry. Thus, expanded fiber within the scope of the above definition will have a 50% volumetric reduction settling consistency of 0.5% or less. For reference, conventional, chemically pulped cellulosic fibers which have been cut to pass through a standard 60 mesh screen (ASTM E-11) will ordinarily have a 50% volumetric reduction settling consistency of about 2%. That is, the cellulose fibers in a 2% consistency slurry of such fibers will settle to 50% of their initial displacement after a period of undisturbed settling of 60 minutes. As discussed above, expanded fiber will have a settling consistency of less than about 0.5%, preferably, a settling consistency of less than about 0.1%. It will be understood by those skilled in the art that aqueous slurries of expanded fiber prepared at consistencies greater than the 50% volumetric settling consistency will have 50% volumetric reductions of the expanded fiber-containing phase in excess of 50% of the initial volume upon 60 minutes of unagitated settling. The following procedure can be used to determine the 50% volumetric reduction settling consistency of cellulosic fibers. First, a series of at least three aqueous slurries containing the cellulosic material treated according to this invention of varying consistencies is prepared. Each slurry is placed in a separate 50 ml graduated cylinder. The slurries are simultaneously agitated and then allowed to settle under unagitated conditions for a period of sixty (60) minutes. Unagitated settling will result in at least partial settling of the cellulosic material to form a cellulose-containing phase and a non-cellulose containing phase. At the end of the settling period, the volume of the cellulose-containing phase is determined from each graduated cylinder. This is referred to as the settling volume. The consistencies of the slurries are chosen such that at least one solution has a consistency prior to settling which is believed to be greater, and one which is believed to be less, than the 50% volumetric reduction settling consistency. A plot is made of settling volume, in terms of percentage of the original volume, versus fiber consistency of the solution, in terms of weight made from the plotted data points. The 50% volumetric reduction settling consistency is interpolated from the curve at the point where the settling volume at the 50% level intersects with the curve.

Opacity is defined as the property of a paper to resist the transmission of both diffuse and nondiffuse light through it. It prevent show through of dark printing in contact with the backside of a sheet of paper. The utility of printing and writing papers is greatly enhanced by high opacity. As used herein "opacified paper structure" refers to paper made more opaque by addition of an opacifying agent, such as a mineral pigment.

Opacity is calculated as the ratio of the apparent reflectance of one sheet of paper with a black backing to the apparent reflectance of the sheet with a white backing. A sample whose reflectance is not changed by changing its backing from white to black will have an opacity of 100 and a sample whose reflectance changes from a high value to zero by changing the backing from white to black will have an opacity of zero.

Opacifying mineral pigments are used in the present invention for the optical improvements they afford to a sheet of paper. In general, optical properties affected by the inclusion of mineral pigment fillers are opacity, brightness, and color. The degree to which each of these properties is altered is very much dependent upon the type of mineral pigment, the nature of the fiber furnish, and the basis weight of the final sheet. At basis weights of $\leqq 60$ g/m$^2$, almost all mineral pigments will, upon inclusion into the web, result in increased sheet opacity. As basis weight is increased, maintenance of a constant level of a mineral pigment will result in a smaller increase in opacity, relative to an unfilled pulp sheet. At very low basis weights, a mineral pigment's opacifying performance is maximized; at higher basis weights, it's minimized.

The opacifying efficiency a pigment possesses in a filler application is related to its ability to scatter light at a wavelength of 572 nm. The scattering power of a pigment is affected by several fundamental factors, namely, its refractive index relative to the surrounding medium, and the particle size (and/or shape) and the number of light scattering surfaces it makes available upon inclusion in the dried web. The higher the refractive index the mineral filler possesses, the greater the light scattering at the air/pigment or fiber/pigment interface. In a filled sheet of paper, it is one of these two interfaces which offer the highest potential source for light scattering resulting in opacity.

Mineral pigment fillers which may be utilized for the present invention include clay, calcium carbonate, titanium dioxide, aluminum trihydrate, amorphous silicas and silicates, satin white, talc, zinc oxide, and barium sulfate and mixtures thereof. Comprehensive data on the physical and chemical characteristics of these materials, together with the manner in which each functions are described in "Pigments for Paper", published by The Technical Association of the Pulp and Paper Industry, Inc. (TAPPI), 1984, hereby incorporated by reference into this disclosure. Preferred mineral pigments for use in the present invention include clay, calcium carbonate, and titanium dioxide and mixtures thereof, with titanium dioxide being most referred.

Titanium dioxide ($TiO_2$) exists in two crystal forms that are commercially important: the anatase and the rutile. The refractive index of rutile (2.70) is higher than that for anatase (2.55), but unless the paper is impregnated with or is made from very highly beaten pulp, this difference has no practical significance. The brightness of titanium pigments is 98 or more, and the particle size is from about 0.3 to about 0.35$\mu$. The high refractive index and the fine particle size give titanium pigments an exceptionally high opacifying effect. Only a fraction as much titanium pigment is needed to produce the same opacity as clay, and this difference is particularly noticeable in paper of low basis weight.

The paper structures of the present invention comprise three essential elements cellulosic fibers, expanded cellulosic fibers, and a mineral pigment filler. In addition, the paper structures may have other components or materials added thereto as may be or later become known in the art, for example, dry and wet strength additives, pigment retention aids, sizing agents, etc.

It should also be mentioned that organic white pigments have been developed. One example is a vinylidene-acrylonitrile polymer that is sold in spheres with a very low specific gravity. These particles will give a high bulk value and good opacity but they have little affinity for cellulosic fibers and the paper must be surface sized. Another disadvantage is the sensitivity toward calendering, which is due to the fact that the particles are hollow microspheres that may collapse under pressure. Synthetic urea formaldehyde pigments have also been used. The paper structures of the present invention may contain these organic white pigments as well as other pigment materials which may be or later become known in the art.

Preferably, the paper structures comprise from about 40 to about 98% cellulosic fibers (not including expanded cellulosic fibers) based on the dry weight of the paper structure and most preferably from about 70% to about 90% cellulosic fibers (not including expanded cellulosic fibers). An effective amount of mineral pigment filler is included to impart the desired optical properties to the paper structure. The amount of mineral pigment required depends on the type of mineral pigment used, final results desired, and will vary widely with the types and uses of the paper structures. Preferably, the pigment content will be from about 1% to about 35% mineral pigment based on the dry weight of the paper structure, and most preferably, from about 5% to about 20% of the mineral pigment. In the special case of titanium dioxide, due to its unique opacifying powers, the amount of mineral pigment used is less, typically from about 1% to about 15%, based on the dry weight of the paper structure.

An effective amount of expanded cellulosic fiber is added to the paper structure to increase the paper's tensile strength and to increase the paper's opacity. The amount of expanded fiber used depends on the type and amount of mineral pigment used, final results desired and type and uses of the paper structures. Preferably, the expanded cellulosic fiber content will be from about 1% to about 25%, based on the dry weight of the paper structure, most preferably from about 5% to about 10%.

The paper structure preferably has a basis weight of from about 20 to about 120 g/m$^2$, most preferably from about 30 g/m$^2$ to about 70 g/m$^2$ and a density of about 1.0 grams or less per cubic centimeter. Most preferably, the density will be from about .50 g/cc to about .90 g/cc.

In a preferred method of making the opacified paper structure of the present invention, the expanded cellulosic fiber and the mineral pigment are added to a papermaking stock furnish comprising a slurry of cellulosic fibers. The papermaking furnish can be readily formed or prepared by mixing techniques and equipment well known to those skilled in the papermaking art. The furnish comprising cellulosic fibers, expanded fiber and mineral pigment is used to form the opacified paper structures of this invention. Any of the various wet-forming techniques well-known in the art for forming sheets of fibers can be used. Of particular usefulness are the various modifications of the Fourdrinier process. In general, this process involves adjusting the furnish to the appropriate consistency, applying the furnish to a moving foraminous surface such as a Fourdrinier wire, allowing excess water to drain from the fiber mat so formed through the foraminous surface, and subjecting the drained fiber mat to various pressing operations so as to expel more water. The coherent fibrous web is then dried by any convenient means such as a drying tunnel or rotating drum dryer. The dried paper structure is then cut into sections or is wound upon a core to form a convenient sized roll.

The following examples illustrate the practice of the present invention but are not intended to be limiting thereof. The handsheeting procedure immediately below is used in the production of handsheets throughout the examples.

Handsheeting Procedure

Northern softwood pulp is prepared by disintegrating dry lap bleached northern softwood Kraft (NSK) pulp in a British disintegrator either alone or with 15% expanded fiber on a total dry solids weight basis, depending on whether the pulp will ultimately be used to prepare handsheets without or with the expanded fiber additive. The standard batch for disintegration is 16.5 grams of solid substance in 2 liters of water. After sufficient batches are prepared, the slurry is transferred to a Williams mold of dimensions 12"×12" fitted with a 100 mesh Monel screen. Sufficient solid substance is charged to the mold to produce a sheet with dry basis weight of 1000 grams per square meter. After forming, the pulp mat is dewatered by passing over a vacuum box and finally by drying at about 112° C. on a steam heated drum.

Northern hardwood Kraft (NHK) pulp (Aspen) is used as received as dry lap.

A titanium dioxide ($TiO_2$) slurry is prepared by adding water to dry $TiO_2$ powder (R901-01 "Ti-Pure" obtained from E.I. duPont de Nemours Company). Sufficient water is added to yield a slurry of 10% solids basis. The $TiO_2$ is dispersed using a laboratory Waring Blender on the low speed setting for 5–10 minutes. This slurry is vigorously agitated immediately prior to use.

A polyelectrolyte (RETEN T.M. type 523 from Hercules, Inc.) is used as a retention aid. It is added near the end of the disintegration cycle, with approximately 30 seconds of disintegration allowed after adding the retention aid.

The dry pulps are soaked in water for a minimum of four hours prior to use. The pulps are then proportioned into the British disintegrator according to the desired pulp blends. Pulps and pigment are both added at the beginning of the ten minute disintegration cycle; the retention aid is added near the end of this cycle with approximately 30 seconds remaining. This is to allow the retention aid to be dispersed with minimal opportunity for flocks to be redispersed by continued high shear conditions.

After disintegration, handsheeting is performed essentially according to T.A.P.P.I. Method T205 om-81. The dry ingredients are proportioned to yield an oven dry basis weight of 60 grams per square meter which is equivalent to approximately 64 grams per square meter on a conditioned air dry basis.

Sheets are formed in a 6.25" circular mold fitted with a 100 mesh stainless steel wire screen. In order to promote maximum retention of fine particles, the drain water is recycled and used for making subsequent sheets in a series. Anticipating that the early sheets in a series might have slightly lower fine particle percentage, the first four sheets in each series are discarded.

After formation of the sheet on the screen, the sheet is couched onto a blotter by using a standard 28 lb. T.A.P.P.I. roller.

The sheets are then alternately stacked between blotters and chrome plates in the press.

After the pressing, the sheets which now adhere to the chrome plates, are transferred to rings which provide the necessary restraint during drying to prevent the sheets from curling or cockling. The sheets are dried in the rings, then removed from the steel plates and conditioned in a controlled environment laboratory at 23° C. and 50% relative humidity prior to testing.

The analysis of the mineral pigment (i.e., $TiO_2$) level in the handsheets is performed gravimetrically by ashing the sheets and weighing the ash.

The opacity of the handsheets containing the mineral pigment is measured according to T.A.P.P.I. Standard T 425 om-86 with a Bausch & Lomb opacimeter.

Since minor variation in basis weight is to be expected, the properties measured on the sheets are corrected to the equivalent values which would be expected if the sheets are prepared at the 64 grams per square meter standard weight.

Preparation of Expanded Fiber

Dry, bleached, southern softwood Kraft (SSK) pulp fibers are sufficiently cut with a knife cutter such that the dry fibers are able to pass through a standard 60 mesh screen (ASTM E-11). The cut fibers are mixed with water to form an aqueous slurry having a 2%, by weight, fiber consistency. The fibers in the slurry are then expanded by treatment with a horizontal fine media mill made by Premier Mill Corporation (New York, N.Y. Specifically, a Model No. 1.5VSD horizontal media mill having a 1.5 liter fibrillating zone volume and five impellers is used. The fibrillating zone contains 80% (by volume of the fibrillating zone) of 1.5 mm effective diameter fine media made from glass. The fine media are substantially elliptical in shape and do not have sharply angled edges. The media screen has 13 mil apertures between passes of the helical ring element and 63 mil apertures between the beams at the juncture between the beam and the helical ring element. The height of the beams i.e., approximately the distance between the inner surface of the helical ring element and the rotatable shaft of the media mill, is about 67 mils.

The SSK slurry is passed through the media mill while the impellers are spinning at a rate of 2680 rpm, corresponding to a 100 foot/minute impeller peripheral speed. The media mill is cooled with ambient temperature cooling water, to maintain a slurry temperature of less than about 40° C.

The slurry is passed through the fibrillating zone for a total of 5 passes in a closed-loop, batch system at a volumetric flow rate of 9.5 gal./hr. for each pass. The 50% volumetric reduction settling consistency of the cellulosic material is determined after each pass through the fibrillating zone. The following 50% volumetric reduction settling consistencies are obtained after each of the passes through the fibrillating zone: Pass 1, 0.88%; Pass 2, 0.31%; Pass 3, 0.18%; Pass 4, 0.12%; and Pass 5, 0.10%. The cellulosic material is sufficiently expanded after Pass 2 to exhibit the gel-like resistance to settling that is characteristic of the herein defined expanded fiber. The slurry becomes more viscous with each pass through the fibrillating zone, although the magnitude of the decreases in 50% volumetric reduction settling consistency are relatively small in the later passes through the fibrillating zone.

Example 1

The purpose of this example is to illustrate the opacity and tensile strength effects resulting from the addition of expanded fiber (EF) to a pulp furnish containing a blend of bleached northern softwood Kraft (NSK), bleached northern hardwood Kraft (NHK) and titanium dioxide ($TiO_2$). Handsheets are prepared in accordance with the previously described handsheeting procedure and compared to handsheets containing no expanded fiber (EF). The expanded fiber is prepared from bleached, southern, softwood Kraft (SSK) pulp in accordance with the above described procedure for preparation of expanded fiber. The pulps in this example are not refined in any manner (except by the disintegration process). The results are reported below in Table 1. Both the tensile strength and opacity values are corrected to the equivalent values which would be expected for handsheets with a basis weight of 64 g/m$^2$.

TABLE 1

| NSK ADDED (%) | NHK ADDED (%) | $TiO_2$ ADDED (%) | $TiO_2$ CONTENT MEASURED (%) | EF ADDED (%) | TENSILE[1] STRENGTH (LB/IN) | OPACITY[2] (%) | BASIS WEIGHT (G/M$^2$) | DENSITY (G/CM$^3$) |
|---|---|---|---|---|---|---|---|---|
| 45 | 50 | 5 | 3.91 | 0 | 9.8 | 88.3 | 62.6 | 0.597 |
| 38.25 | 50 | 5 | 4.2 | 6.75 | 14.1 | 90.2 | 65.4 | 0.617 |
| 40 | 50 | 10 | 5.84 | 0 | 9.7 | 89.1 | 63 | 0.594 |
| 34 | 50 | 10 | 6.43 | 6 | 13.3 | 91 | 63.2 | 0.63 |
| 35 | 50 | 15 | 11.97 | 0 | 8.5 | 91.9 | 64.7 | 0.618 |
| 29.75 | 50 | 15 | 13.36 | 5.25 | 10 | 92.9 | 66.7 | 0.648 |

[1]Corrected to 64 g/m$^2$ basis weight
[2]Corrected to 64 g/m$^2$ basis weight

The data in Table 1 demonstrates that the addition of expanded fiber to the pulp furnish results in significant increases in both the tensile strength and the opacity of the handsheets at all three $TiO_2$ addition levels (i.e., 5%, 10% and $TiO_2$). That is, the addition of expanded fiber to a pulp furnish makes it possible to simultaneously increase the opacity and the tensile strength of the resulting paper.

Example 2

The purpose of this example is to illustrate the opacity and strength effects resulting from the addition of expanded fiber to a lightly refined pulp furnish containing a blend of NSK pulp, NHK pulp, and $TiO_2$. Handsheets are prepared in accordance with the previously described handsheeting procedure and compared to handsheets containing no expanded fiber (EF). The expanded fiber is prepared from bleached southern softwood Kraft (SSK) pulp in accordance with the previously described procedure for preparation of expanded fiber. The main difference between this example and Example 1 is that the pulp blends in this example are refined to 00 revolutions on a PFI mill, according to recommended method C.7 from the Canadian Pulp and Paper Association. The results are reported below in Table 2, with the tensile strength and opacity values corrected to the equivalent value for paper with a basis weight of 64 g/m$^2$.

TABLE 2

| NSK ADDED (%) | NHK ADDED (%) | $TiO_2$ ADDED (%) | $TiO_2$ CONTENT MEASURED (%) | EF ADDED (%) | TENSILE[1] STRENGTH (LB/IN) | OPACITY[2] (%) | BASIS WEIGHT (G/M$^2$) | DENSITY (G/CM$^3$) |
|---|---|---|---|---|---|---|---|---|
| 45 | 50 | 5 | 4 | 0 | 19.3 | 86 | 60 | 0.685 |
| 38.25 | 50 | 5 | 3.62 | 6.75 | 22.5 | 87.6 | 60.8 | 0.7 |
| 40 | 50 | 10 | 8.5 | 0 | 17 | 89.1 | 60 | 0.694 |
| 34 | 50 | 10 | 8.93 | 6 | 17.9 | 90.7 | 56.5 | 0.689 |
| 35 | 50 | 15 | 12.74 | 0 | 12.3 | 91.9 | 59.4 | 0.632 |
| 29.75 | 50 | 15 | 14.79 | 5.25 | 17.3 | 92.5 | 58.4 | 0.708 |

[1]Corrected to 64 g/m$^2$ basis weight.
[2]Corrected to 64 g/m$^2$ basis weight.

The data in table 2 shows that the addition of expanded fiber results in a significant increase in both The tensile strength and the opacity of the handsheets containing lightly refined pulp blends at each level of $TiO_2$ addition (i.e., 5%, 10% and 15%).

From the foregoing specification, one skilled in the art can easily ascertain the essential characteristics of this invention, and without departing from the spirit and scope thereof, may make various changes and modifications to adapt the invention to various usages and conditions not specifically mentioned herein. The scope of this invention shall be defined by the claims which follow.

What is claimed is:

1. An opacified paper structure comprising cellulosic fibers, from about 1% to about 25% expanded cellulosic fibers, based on the dry weight of said opacified paper structure, and an effective amount of an opacifying mineral pigment, said paper having a basis weight from about 20 to about 120 grams per square meter, and a density of about 1.0 grams or less per cubic centimeter.

2. The opacified paper structure of claim 1 wherein the effective amount of said mineral pigment is from about 1% to about 35% based on the dry weight of said opacified paper structure.

3. The opacified paper structure of claim 2 wherein the basis weight of said paper structure is from about 30 to about 70 grams per square meter.

4. The opacified paper structure of claim 2 wherein said mineral pigment is selected from the group consisting of titanium dioxide, clay, calcium carbonate, aluminum trihydrate, amorphous silicas and silicates, satin white, talc, zinc oxide, barium sulfate, and mixtures thereof.

5. The opacified paper structure of claim 4 wherein said mineral pigment is selected from the group consisting of titanium dioxide, clay, calcium carbonate, and mixtures thereof.

6. The opacified paper structure of claim 5 wherein said mineral pigment is titanium dioxide.

7. The opacified paper structure of claim 2 wherein the effective amount of said mineral pigment is from about 1% to about 20% mineral pigment based on the dry weight of said paper structure, and wherein the effective amount of said expanded cellulosic fiber is from about 5% to about 10% based on the dry weight of the paper structure.

8. The opacified paper structure of claim 7 wherein said mineral pigment is titanium dioxide in an amount of from about 1% to about 15% based on the dry weight of the paper structure.

9. The opacified paper structure of claim 7 wherein said cellulosic fibers and said expanded cellulosic fibers comprise chemical pulp fibers.

10. The opacified paper structure of claim 7 wherein the basis weight of said paper structure is from about 30 to about 70 grams per square meter, and the density is from about .50 grams per cubic centimeter to about .90 grams per cubic centimeter.

11. The opacified paper structure of claim 10 wherein the mineral pigment is titanium dioxide in an amount from about 1% to about 15% based on the dry weight of the paper structure.

* * * * *